US005503540A

United States Patent [19]

Kim

[11] Patent Number: 5,503,540

[45] Date of Patent: Apr. 2, 1996

[54] DEVICE FOR DISCHARGING COMPRESSED GAS OF ROTARY TYPE GAS COMPRESSOR

[75] Inventor: Yang-Sun Kim, Seoul, Rep. of Korea

[73] Assignee: Samsung Electronics Co., Ltd., Suwon, Rep. of Korea

[21] Appl. No.: 177,972

[22] Filed: Jan. 6, 1994

[30] Foreign Application Priority Data

Jan. 6, 1993 [KR] Rep. of Korea ..... 93-74

[51] Int. Cl.[6] ..... F04C 2/00

[52] U.S. Cl. ..... 418/65; 418/251

[58] Field of Search ..... 418/65, 248, 251

[56] References Cited

U.S. PATENT DOCUMENTS 3,519,374 7/1970 Tauson ..... 418/65

4,580,957 4/1986 Fickelscher et al. ..... 418/65

4,669,963 6/1987 Ishihara et al. ..... 418/65

*Primary Examiner*—Charles Freay

*Attorney, Agent, or Firm*—Burns, Doane, Swecker & Mathis

[57] ABSTRACT

A rotary gas compressor comprises an eccentric roller rotating within a cylinder to form, together with a wall of the cylinder, a suction chamber and a compression chamber. The suction and compression chambers are separated from one another by a vane which slides within a slide hole such that an edge of the vane continuously bears against the roller and is caused to slide during rotation of the roller. Gas is sucked into the suction chamber, compressed in the compression chamber, and then discharged through a discharge port. The discharge port does not communicate directly with the compression chamber, but rather communicates with the slide hole. The vane has a gas flow recess formed therein and positioned to intermittently connect the compression chamber with the discharge port to permit gas to be discharged.

1 Claim, 5 Drawing Sheets

DEVICE FOR DISCHARGING COMPRESSED GAS OF ROTARY TYPE GAS COMPRESSOR

BACKGROUND OF THE INVENTION

1. Field of the Invention

The present invention relates in general to a rotary type gas compressor used in refrigerators, room air conditioners and the like and, more particularly, to a device for discharging compressed refrigerant gas from a compression cylinder of the rotary type gas compressor.

2. Description of the Prior Art

As well known to those skilled in the art, air conditioning apparatus, such as a refrigerator or a room air conditioner, typically includes a gas compressor for compressing a refrigerant gas of high temperature and low pressure. This compressor receives the refrigerant gas, which has exchanged the heat with outside air during its flow in an evaporator and changed its liquid state into a gaseous state, and compresses the refrigerant gas and, thereafter, forcibly discharges the compressed refrigerant gas to a continued condenser.

The gas compressors are generally classified into three types, that is piston type compressors, rotary type compressors and recently proposed scroll type compressors, otherwise called screw type compressors.

With reference to FIG. 1, there is shown a construction of a typical rotary type gas compressor. This rotary type gas compressor (hereinbelow, referred to simply as "the rotary compressor") comprises drive means for generation of a rotational force used in compression of refrigerant gas. The rotary compressor further comprises compression means carrying out suction, compression and discharge of the refrigerant gas using the rotational force of the drive means.

The drive means uses a motor which comprises a stator 11 and a rotor 12. The rotor 12 is provided with a rotating shaft 13 at its center.

The compression means comprises an eccentric roller 21, which is eccentrically mounted on the rotor shaft 13 of the motor, and a compression cylinder 22 which receives the roller 21 and defines a compression working chamber therein. In the compression working chamber of the cylinder 22, the roller 21 is eccentrically revolved by the rotational force of the motor and compresses the refrigerant gas sucked into the chamber through a suction port 20.

Upper and lower openings of the compression cylinder are closely covered by first and second flanges 22*a* and 22*b*, respectively, thus to achieve the desired hermetic state of the compression working chamber. The suction port 20 communicates with a refrigerant gas accumulator 10 which is in burn connected to an evaporator (not shown).

Turning to FIG. 2, there is shown a construction of a compressed gas discharging device of the above compressor. In the gas discharging device, a retractable vane 23 is radially placed in a wall of the compression cylinder 22 at a position near the suction port 20.

The retractable vane 23 is a rectangular plate having a predetermined thickness as best seen in FIGS. 3*a* and 3*b*. This vane 23 is biased by spring means (not shown) at its lower end and always slidably contacts an outer surface of the eccentric roller 21 at its upper end. Hence, the eccentric revolution of the roller 21 causes the vane 23 to be radially elastically reciprocated. This retractable vane 23 also divides the compression working chamber inside the cylinder 22 into two variable chambers, that is, a gas suction chamber and a gas compression chamber.

A refrigerant gas discharge port 25 is formed in a wall of the compression cylinder 22 at a position neighboring the retractable vane 23 in order for discharge of compressed refrigerant gas from the cylinder 22.

This discharge port 25 is opened or closed by an elastic plate valve 26 mounted on the first flange 22*a* of the cylinder 22.

In operation of the above typical rotary compressor, the motor rotates and generates the rotational force as it is applied with electric power. The rotational force of the motor is transmitted to the eccentric roller 21 through the rotor shaft 13, thus to cause eccentric revolution of the roller 21 in the compression cylinder 22. As a result of the eccentric revolution of the roller 21 in the cylinder 22, the refrigerant gas of the accumulator 10 is introduced into the compression chamber of the cylinder 22 through the suction port 20. This refrigerant gas is, thereafter, compressed due to the eccentric revolution of the roller 21 and discharged from the cylinder 22 through the discharge port 25.

That is, when the eccentric roller 21 is eccentrically revolved clockwise in the cylinder 22 by the rotational force of the motor as shown in FIG. 2, the refrigerant gas of the accumulator 10 is introduced into the gas suction chamber, which is defined at the side of the suction port 20 by the roller 21, the cylinder 22 and the vane 23, through the suction port 20.

The sucked refrigerant gas is in turn compressed in the gas compression chamber due to the eccentric revolution of the roller 21.

When the refrigerant gas in the gas compression chamber is completely compressed, the elastic plate valve 26 is pushed by the pressure of the compressed refrigerant gas and opens the discharge port 25, thus to discharge this compressed refrigerant gas from the cylinder 22.

A continued eccentric revolution of the roller 21 completely retracts the vane 23, thus to integrate the gas suction chamber and the gas compression chamber into one chamber.

At this state, the elastic plate valve 26 closes the discharge port 25 by its own restoring force since the integrated one chamber is filled with newly sucked refrigerant gas which has such low pressure that it can not overcome the elasticity of the plate valve 26.

The newly sucked refrigerant gas of low pressure is in turn compressed in accordance with continued eccentric revolution of the roller 21 and discharged from the cylinder 22 in the same manner as described above.

In operation of the above rotary compressor, the aforementioned suction, compression and discharge of the refrigerant gas is repeated.

However, the typical gas discharging device of the rotary compressor, including the elastic plate valve for opening and closing a gas discharge port, has a problem that there is generated a noise in the opening and closing operation of the plate valve. Another problem of this typical gas discharging device of the rotary compressor is that the use of plate valve makes the construction complex and increases the chance of malfunction of the compressor.

SUMMARY OF THE INVENTION

It is, therefore, an object of the present invention to provide a device for discharging compressed gas of a rotary compressor which reduces the operational noise generated in operation of the compressor.

It is another object of the present invention to provide a device for discharging compressed gas of a rotary compressor which simplifies its construction and reduces the chance of malfunction of the compressor.

In order to accomplish the above objects, a device for discharging compressed gas of a rotary compressor in accordance with a preferred embodiment of the present invention comprises a gas discharging port provided in a compression cylinder and communicating with a vane slide hole, a gas flow recess provided on a retractable vane such that it communicates a compression chamber of the cylinder to the gas discharging port only when the vane is in a gas discharging position, and a gas guide slot formed on an inner surface of the cylinder at an edge of the vane sliding hole and guiding the compressed gas toward the gas flow recess of the vane.

BRIEF DESCRIPTION OF THE DRAWINGS

The above and other objects, features and other advantages of the present invention will be more clearly understood from the following detailed description taken in conjunction with the accompanying drawings, in which:

FIGS. 3*a* and 3*b* are views of a retractable vane of the rotary compressor FIG. 1, in which:

FIG. 3*a* is a plan view; and

FIG. 3*b* is a front view;

FIGS. 5*a* and 5*b* are views of a retractable vane of the rotary compressor FIG. 4, in which:

FIG. 5*a* is a plan view; and

FIG. 5*b* is a front view;

FIGS. 6*a* and 6*b* are schematic sectional views representing an operation of the compressed gas discharging device of FIG. 4, in which:

FIG. 6*a* shows a positional state of the device in a gas compression step; and FIG. 6*b* shows a positional state of the device in a compressed gas discharging step.

DESCRIPTION OF THE PREFERRED EMBODIMENTS

Figure 1:
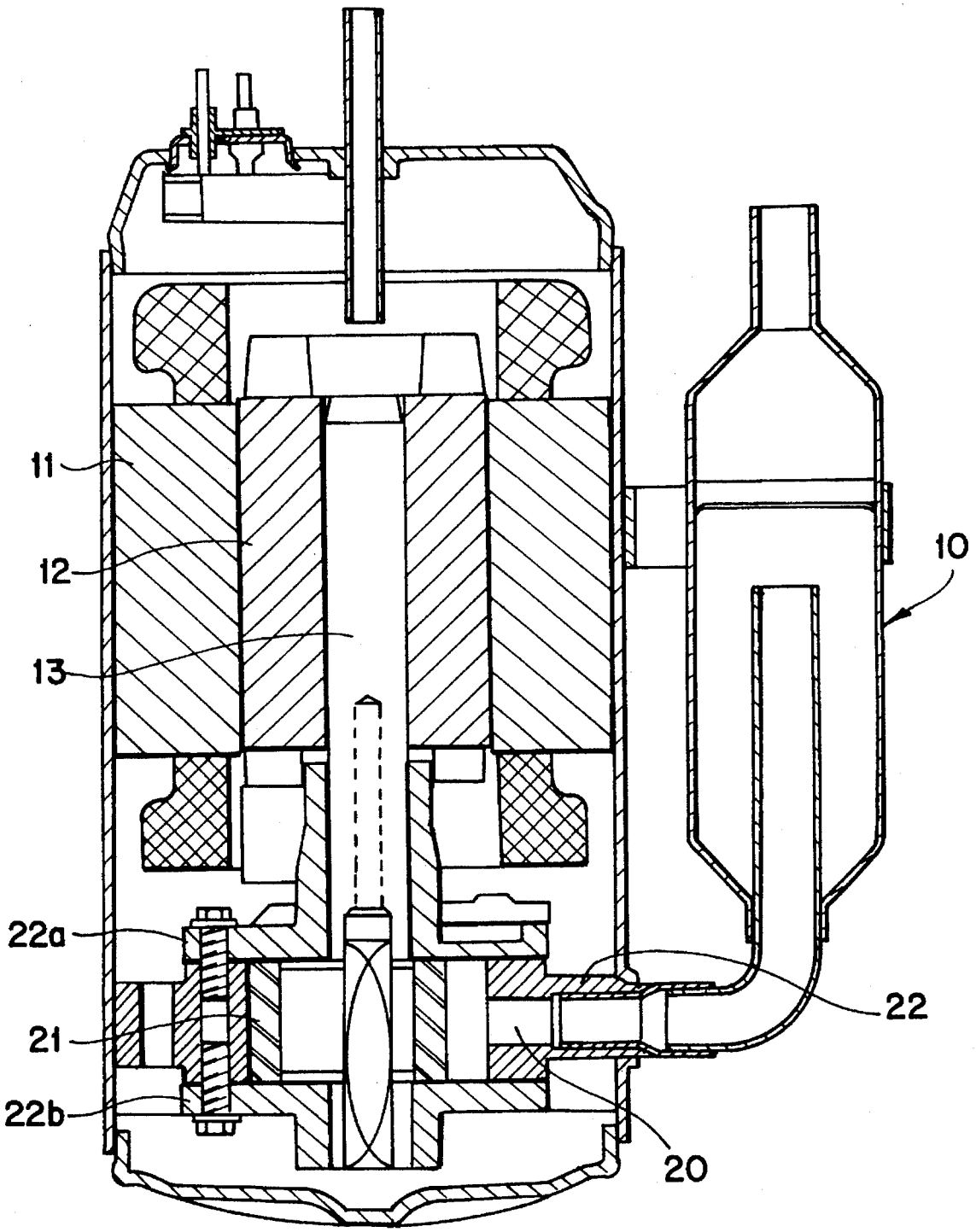
FIG. 1 (PRIOR ART)
FIG. 1 is a longitudinal sectional view of a typical rotary compressor.
Figure 2:
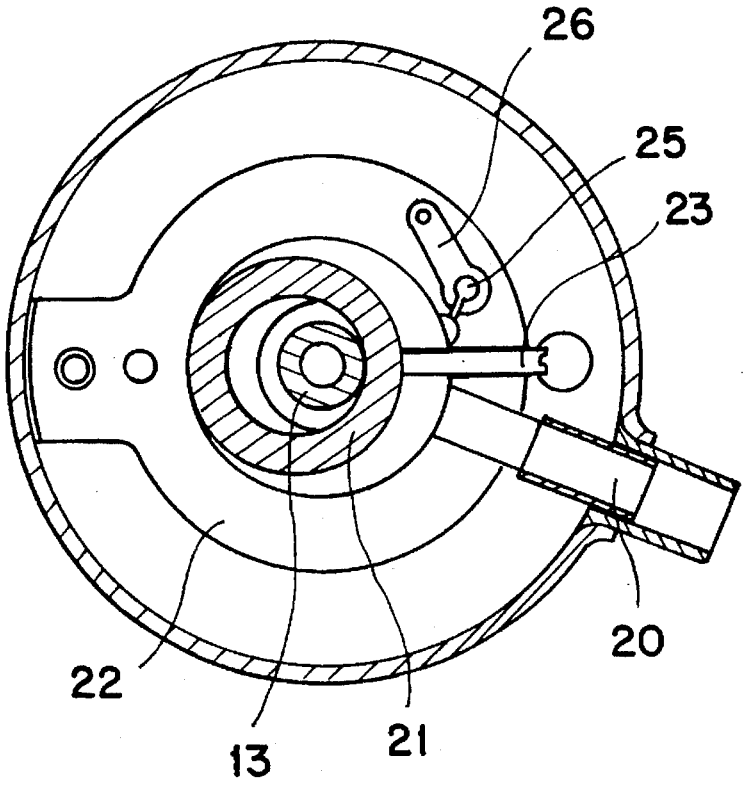
FIG. 2 (PRIOR ART)
FIG. 2 is a cross sectional view of a compressed gas discharging device of the rotary compressor of FIG. 1.
Figure 3A:
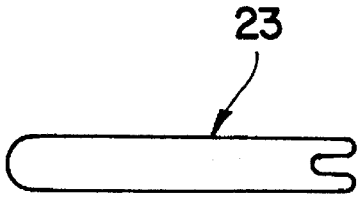
FIG. 3(a) (PRIOR ART)
Figure 3B:
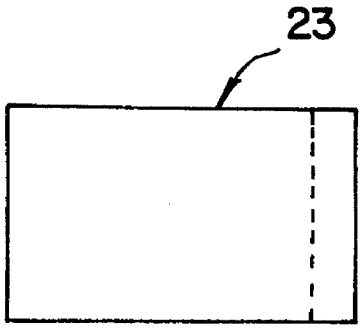
FIG. 3(b) (PRIOR ART)
Figure 4:
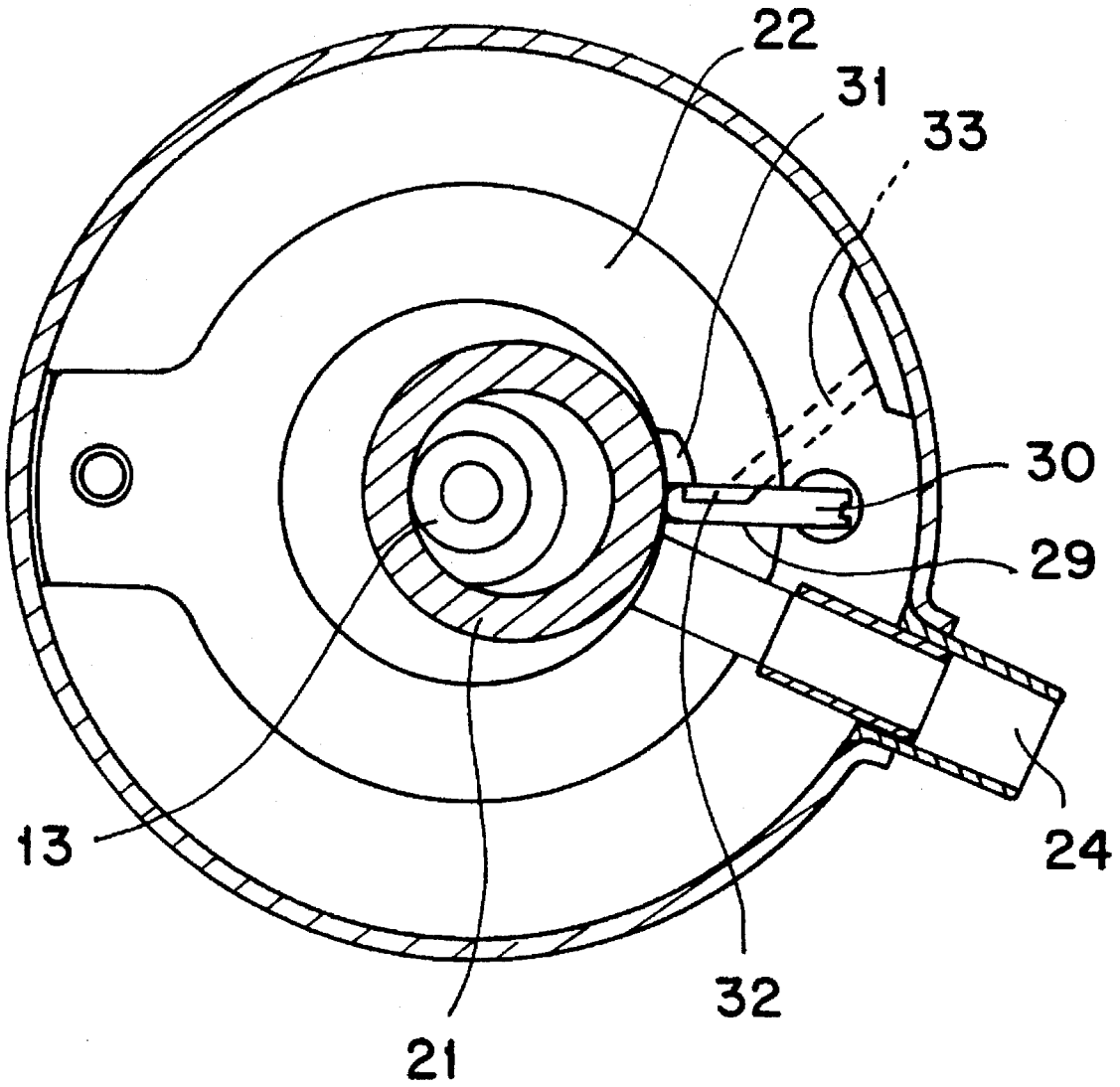
FIG. 4 is a cross sectional view of a compressed gas discharging device of a rotary compressor in accordance with an embodiment of the present invention.

With reference to FIG. 4, there is shown a construction of a compressed gas discharging device of a rotary compressor in accordance with an embodiment of the present invention. The rotary compressor comprises a compression cylinder 22 defining a compression working chamber therein. An eccentric roller 21 is received in the compression cylinder 22. This eccentric roller 21 is eccentrically mounted on a rotor shaft 13 of a motor (see FIG. 1), so that the roller 21 is eccentrically revolved in the cylinder 22 by the rotational Force of the motor in order for carrying out suction, compression and discharge of a refrigerant gas sucked into the compression working chamber. A suction port 24 is formed in a wall of the cylinder 22 for introduction of the refrigerant gas into the cylinder 22.

A slide hole 29 is radially formed in the wall of the cylinder 22 at a position neighboring the suction port 24 and receives a retractable vane 30.

Figure 5A:
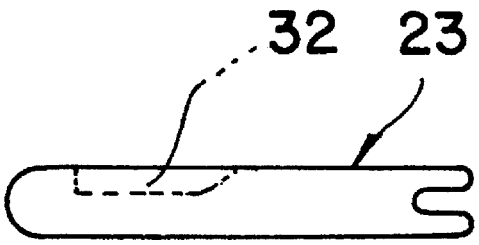
Figure 5B:
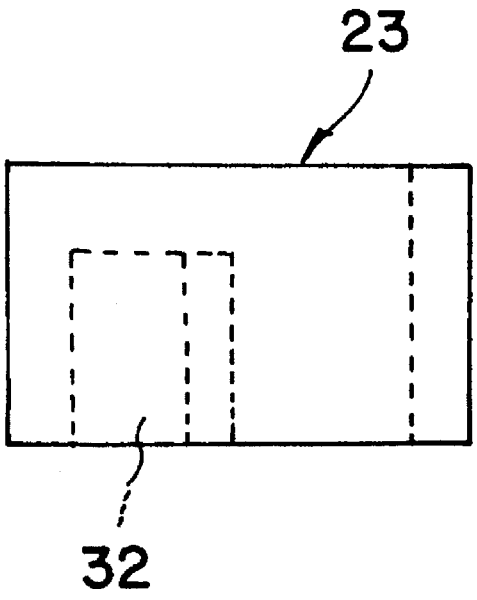

The retractable vane 30 is a rectangular plate having a predetermined thickness. This vane 30 also has a refrigerant gas flow recess 32 on a surface thereof as best seen in FIGS. 5*a* and 5*b*.

This vane 30 is received in the slide hole 29 of the cylinder 22 and biased by spring means (not shown) at its lower end and always slidably contacts with an outer surface of the eccentric roller 21 at its upper end. Hence, the eccentric revolution of the roller 21 causes the vane 23 to be radially elastically reciprocated in the slide hole 29. This retractable vane 23 also divides the compression working chamber of the cylinder 22 into two variable chambers, that is, a gas suction chamber and a gas compression chamber.

A gas guide slot 31 is formed on an inner surface of the cylinder wall at an edge of the sliding hole 29 receiving the vane 30.

This gas guide slot 31 shows a streamlined recessed shape such that it smoothly guides the flow of compressed refrigerant gas toward the gas flow recess 32 of the vane 30.

A compressed gas discharge port 33 is formed in the wall of the compression cylinder 22 and extends from the slide hole 29 to the outside of the cylinder 22. This gas discharge port 33 discharges the compressed refrigerant gas, which has been introduced to the gas flow recess 32 of the vane 30, to the outside of the cylinder such as to a condenser.

In operation of the above rotary compressor, the motor generates the rotational force as it is applied with electric power. The rotational force of the motor is transmitted to the eccentric roller 21 through the rotor shaft 13, thus to eccentrically revolve this roller 21 in the compression cylinder 22. As a result of the eccentric revolution of the roller 21 in the cylinder 22, the refrigerant gas of the accumulator 10 is introduced into the compression working chamber of the cylinder 22 through the suction port 24. This refrigerant gas is, thereafter, compressed and discharged from the cylinder 22 through the gas discharge port 33. The gas suction, compression and discharge operation of the compressor is repeated.

Figure 6A:
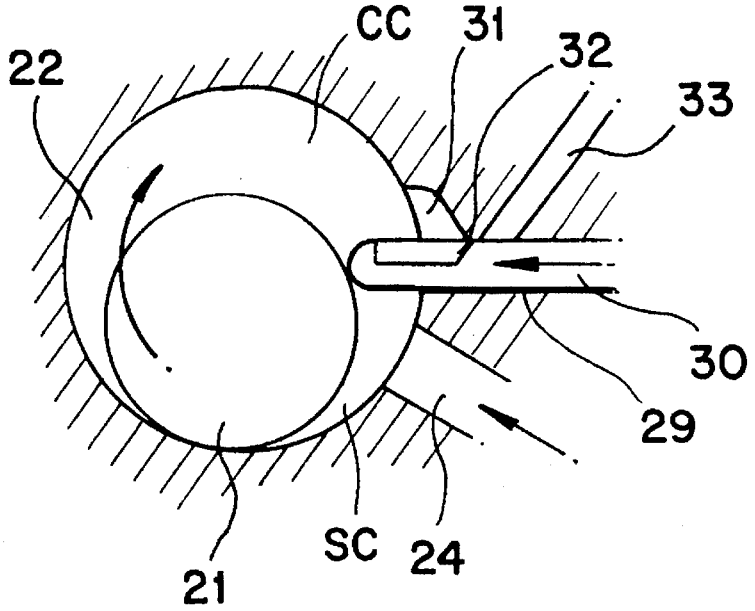

That is, after the most eccentric portion or the contact portion of eccentric roller 21 sliding on the inner surface of the cylinder 22 has passed by the retractable vane 30 as shown in FIG. 6*a*, the gas suction chamber SC which is defined at the side of the suction port, 24 by the revolving roller 21, the cylinder 22 and the vane 30 is gradually increased in its volume. Hence, the refrigerant gas of the accumulator is introduced into the suction chamber through the suction port 24.

In addition, the gas compression chamber CC which is defined at the side of the gas guide slot 31 by the revolving roller 21, the cylinder 22 and the vane 30 is gradually reduced in its volume as a result of eccentric revolution of the roller 21. Hence, the refrigerant gas in the compression chamber is compressed.

At this time, the vane 30 is biased by the spring means in order to radially advance to the inside of the cylinder 22 and, as a result, blocks the gas discharge port 33. The compressed refrigerant gas is thus not discharged from the cylinder 22.

Figure 6B:
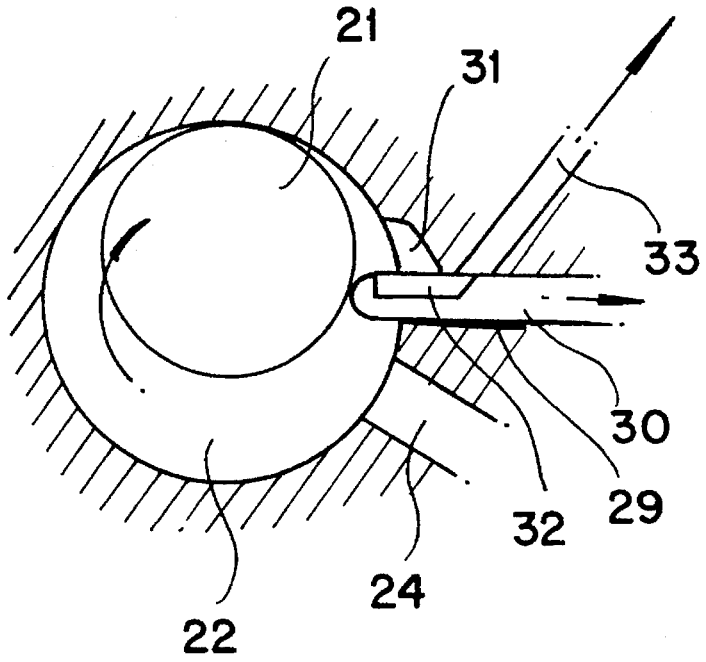

When the revolving roller 21 achieves the positional state of FIG. 6*b* as a result of its eccentric revolution, the vane 30 is retracted in the slide hole 29 by the roller 21. At this state, both the gas guide slot 31 and the gas discharge port 33 communicate with each other by way of the gas flow recess 32 of the vane 30.

The compressed refrigerant gas in the compression cylinder 22 is thus slowly discharged from the cylinder 22 by way of the guide slot 31, the gas flow recess 32 and the gas discharge port 33 in order.

The discharge of the compressed refrigerant gas is completely achieved when the retractable vane 30 is most retracted in the slide hole 29 by the continued revolution of the roller 21 (see FIG. 4).

After the roller 21 has passed by the vane 30, the vane 30 elastically advances to the inside of the cylinder 22 by the restoring force of the spring means and closes the gas discharge port 33. During the eccentric revolution of the roller 21, the suction of the refrigerant gas through the suction port 24 is carried out at the same time of compression of existing refrigerant gas.

As described above, a compressed gas discharging device of the a rotary compressor of the present invention controls the discharge of compressed refrigerant gas from a compression cylinder using a retractable vane, thus to requires no additional member for controlling the discharge of the compressed refrigerant gas.

Another advantage of the device of this invention is resided in that its construction is very simplified since it has no additional member for controlling the discharge of the compressed refrigerant gas.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, there may exist a variety of different configurations of the gas guide slot and the gas flow recess.

What is claimed is:

1. A rotary gas compressor, comprising:

a housing forming a cylinder;

a motor-driven eccentric roller arranged for eccentric rotation in said cylinder to form, together with a wall of said cylinder, a suction chamber and a compression chamber;

a retractable vane slidably disposed in a slide hole formed in said housing and being slidable in said slide hole in response to eccentric rotation of said roller;

a gas inlet for conducting gas to said suction chamber;

a gas discharge port formed at an oblique angle with respect to the vane for conducting high pressure gas from said compression chamber to the outside;

said vane being arranged to alternately open and close said gas discharge port with respect to said compression chamber in response to sliding movement of said vane;

wherein said retractable vane is constructed at one side thereof with a gas flow recess which interconnects said compression chamber with said gas discharge port in one position of said vane and which is in non-interconnecting relationship with said compression chamber and said gas discharge port in another position of said vane; and said compression chamber includes a guide slot formed in said wall of said cylinder, said guide slot communicating with said slide hole, said gas flow recess being arranged to interconnect said gas discharge port with said guide slot in said one position of said vane.

* * * * *